US006194130B1

(12) United States Patent
Nair et al.

(10) Patent No.: US 6,194,130 B1
(45) **Date of Patent: *Feb. 27, 2001**

(54) PROTECTIVE OVERCOAT COMPRISING POLYVINYL ALCOHOL FOR PHOTOGRAPHIC ELEMENTS

(75) Inventors: Mridula Nair, Penfield; Tamara K. Jones, Rochester; Tiecheng A. Qiao, Webster, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/448,213

(22) Filed: Nov. 23, 1999

(51) Int. Cl.[7] ..... G03C 1/76; G03C 1/815; G03C 5/29; G03C 11/06

(52) U.S. Cl. ..... 430/350; 430/432; 430/434; 430/512; 430/531; 430/536; 430/961

(58) Field of Search ..... 430/531, 536, 430/350, 961, 512, 432, 434

(56) References Cited

U.S. PATENT DOCUMENTS

| | | | | |
|---|---|---|---|---|
| 4,797,353 | | 1/1989 | Yamada et al. | 430/434 |
| 5,177,128 | | 1/1993 | Lindemann et al. | 524/44 |
| 5,695,920 | | 12/1997 | Anderson et al. | 430/531 |
| 5,804,360 | | 7/1998 | Schell et al. | 430/531 |
| 5,846,699 | | 12/1998 | Wang et al. | 430/536 |
| 5,853,926 | | 12/1998 | Bohan et al. | 430/531 |
| 5,866,282 | * | 2/1999 | Bourdelais et al. | 430/536 |
| 5,910,401 | | 6/1999 | Anderson et al. | 430/531 |
| 6,077,648 | * | 6/2000 | Nair et al. | 430/531 |

* cited by examiner

*Primary Examiner*—Richard L. Schilling
(74) *Attorney, Agent, or Firm*—Chris P. Konkol

(57) ABSTRACT

The present invention is a photographic element which includes a support, at least one silver halide emulsion layer superposed on the support and a processing-solution-permeable protective overcoat overlying the silver halide emulsion layer. The processing solution permeable overcoat is composed of a urethane-containing component having acid functionalities wherein a weight ratio of a polyurethane-containing component in the copolymer comprises from 20 to 100 percent and a weight ratio of an optional vinyl component in the copolymer comprises from 0 to 80 percent, which urethane-containing component of the overcoat may comprise either a single polyurethane polymer or an interpenetrating network comprising two or more polymers. The overcoat further comprises a polyvinyl alcohol polymer having a molecular weight of about 150,000 or less, with the proviso that the degree of hydrolysis is less than 95% when the molecular weight is more than about 100,000. The present invention is also directed to a method of making a photographic print involving developing the photographic element.

15 Claims, No Drawings

PROTECTIVE OVERCOAT COMPRISING POLYVINYL ALCOHOL FOR PHOTOGRAPHIC ELEMENTS

FIELD OF THE INVENTION

The present invention relates to photographic elements having a protective overcoat that resists fingerprints, common stains, and spills. More particularly, the present invention provides a processing-solution-permeable protective overcoat that is water resistant in the final processed product.

BACKGROUND OF THE INVENTION

Silver-halide photographic elements contain light sensitive silver halide in a hydrophilic emulsion. An image is formed in the element by exposing the silver halide to light, or to other actinic radiation, and developing the exposed silver halide to reduce it to elemental silver.

In color photographic elements, a dye image is formed as a consequence of silver-halide development by one of several different processes. The most common is to allow a by-product of silver-halide development, oxidized silver-halide developing agent, to react with a compound called a coupler to form the dye image. The silver and unreacted silver halide are then removed from the photographic element, leaving a dye image.

In either case, formation of the image commonly involves liquid processing with aqueous solutions that must penetrate the surface of the element to come into contact with silver halide and coupler. Thus, gelatin and similar natural or synthetic hydrophilic polymers have proven to be the binders of choice for silver-halide photographic elements. Unfortunately, when gelatin or similar polymers are formulated so as to facilitate contact between the silver halide crystal and aqueous processing solutions, the resultant coatings are not as fingerprint and stain resistant as would be desired for something that is handled in the way that an imaged photographic element may be handled by various persons at various times and in various circumstances. Thus, fingerprints can permanently mark the imaged element. The imaged element can be easily stained by common household products, such as foods or beverages, for example, coffee spills.

There have been attempts over the years to provide protective layers for gelatin-based photographic systems that will protect the images from damage by water or aqueous solutions. U.S. Pat. No. 2,173,480 describes a method of applying a colloidal suspension to moist film as the last step of photographic processing before drying. A number of patents describe methods of solvent coating a protective layer on the image after photographic processing is completed and are described, for example, in U.S. Pat. Nos. 2,259,009, 2,331,746, 2,798,004, 3,113,867, 3,190,197, 3,415,670 and 3,733,293. More recently, U.S. Pat. No. 5,376,434 describes a protective layer formed on a photographic print by coating and drying a latex on a gelatin-containing layer bearing an image. The latex is a resin having a glass transition temperature of from 30° C. to 70° C. Another type of protective coating involves the application of UV-polymerizable monomers and oligomers on a processed image followed by radiation exposure to form a crosslinked protective layer, which is described in U.S. Pat. Nos. 4,092,173, 4,171,979, 4,333,998 and 4,426,431. A drawback for both the solvent-coating method and for the radiation-cure method is the health and environmental concern of those chemicals or radiation to the coating operator. Another drawback is that the photographic materials need to be coated after the processing step. Thus, the processing equipment needs to be modified and the personnel running the processing operation need to be trained to apply the protective coating.

Various lamination techniques are known and practiced in the trade. U.S. Pat. Nos. 3,397,980, 3,697,277 and 4,999,266 describe methods of laminating a polymeric sheet film, as a protective layer, on a processed image. U.S. Pat. No. 5,447,832 describes the use of a protective layer containing a mixture of high and low Tg latices as a water-resistant layer to preserve the antistat property of a $V_2O_5$ layer through photographic processing. This protective layer is not applicable to the image formation layers, however, since it will detrimentally inhibit the photographic processing. U.S. Pat. No. 3,443,946 provides a roughened (matte) scratch-protective layer, but not one designed to be water-impermeable or water-resistant. U.S. Pat. No. 3,502,501 is intended to provide protection against mechanical damage only; the layer in question contains a majority of hydrophilic polymeric materials, and must be permeable to water in order to maintain processability. U.S. Pat. No. 5,179,147 likewise provides a layer that is not water-protective.

Protective coatings that need to be applied to the image after it is formed, several of which were mentioned above, adds a significant cost to the final imaged product. A number of patents have been directed to water-resistant protective coatings that can be applied to an photographic element prior to development. For example, U.S. Pat. No. 2,706,686 describes the formation of a lacquer finish for photographic emulsions, with the aim of providing water- and fingerprint-resistance by coating the light-sensitive layer, prior to exposure, with a porous layer that has a high degree of water permeability to the processing solutions. After processing, the lacquer layer is fused and coalesced into a continuous, impervious coating. The porous layer is achieved by coating a mixture of a lacquer and a solid removable extender (ammonium carbonate), and removing the extender by sublimation or dissolution during processing. The overcoat as described is coated as a suspension in an organic solvent, and thus is not desirable for large-scale application. More recently, U.S. Pat. No. 5,853,926 to Bohan et al. discloses a protective coating for a photographic element, involving the application of an aqueous coating comprising polymer particles and a soft polymer latex binder. This coating allows for appropriate diffusion of photographic processing solutions, and does not require a coating operation after exposure and processing. Again, however, the hydrophobic polymer particles must be fused to form a protective coating that is continuous and water-impermeable.

The ability to provide the desired property of post-process water/stain resistance of an imaged photographic element, at the point of manufacture of the photographic element, is a highly desired feature. However, in order to accomplish this feature, the desired photographic element should be permeable to aqueous solutions during the processing step, but after processing achieve water resistance and even water impermeability for at least some time after contact with water. U.S. Ser. No. 09/235,436 now U.S. Pat. No. 6,077,648 discloses the use of a processing solution permeable overcoat that is composed of a urethane-vinyl copolymer having acid functionalities. However, the limitation of coating such a polymer is that, at coverages desired for durability, the overcoat tends to exhibit defects such as cracks which are formed during the coating process. In addition, the presence of the overcoat causes a slight decrease in the permeation and reaction rates of the developer with the light sensitive emulsions in the underlying layers, resulting in a greater possibility of variability in image-quality. U.S. Ser. No. 09/235,437 pending discloses the use of a second polymer such as a gelatin or polyvinyl alcohol to reduce such defects and disadvantages. U.S. Ser. No. 09/447,409 pending discloses the benefits of the polyurethane-containing component of the overcoat being in the form of an interpenetrating network.

Protective coatings containing gelatin-grafted polyurethanes using pendant carboxylic acid groups on the polyurethanes for grafting, further in combination with polyvinyl alcohols, have been disclosed for use as overcoats on the non-emulsion side of photographic elements. See, for example, U.S. Pat. No. 5,910,401 and 5,846,699. U.S. Pat. No. 5,846,699 discloses a mixture of a polyurethane and a carboxylic acid containing polymer having an acid number of 60 to 260, to provide resistance to abrasion and the like, for example on the back of a photographic element.

Polyurethane-containing interpenetrating networks have been used in coatings for paper. See, for example, U.S. Pat. No. 5,177,128. None of these patents, however, disclose interpenetrating polymer networks comprising polyurethane or polyurethanes with an acid number of at least 5 in a protective coating applied over a silver-halide emulsion layer of a photographic element.

Therefore, there remains a need for, and it would be highly desirable to obtain, a protective overcoat for an photographic element that can be coated free of defects such as cracks and which, at the same time, would not significantly reduce the rate of reaction of the developer with the underlying emulsions, but which would also provide a water resistant and durable overcoat after the processing or developing step. Furthermore, there is a need for a commercially viable water-resistant coating that can be applied to an photographic element prior to exposure and which is permeable to water during development and which becomes relatively impermeable to water in the final product without necessitating a fusing step.

SUMMARY OF THE INVENTION

The present invention is directed to a processing-solution-permeable overcoat for a photographic element that provides water resistance in the final product. For example, such a photographic element may comprise a support, at least one silver-halide emulsion layer superposed on the support, and overlying the silver-halide emulsion layer, a processing-solution-permeable protective overcoat. The processing-solution-permeable overcoat is composed of a polyurethane-containing component having acid functionalities wherein the weight ratio of a polyurethane in the polyurethane-containing component of the overcoat comprises from 20 to 100 percent, and the weight ratio of an optional vinyl polymer in the component comprises from 0 to 80 percent. Thus, the polyurethane-containing component may comprise a urethane copolymer (single polymer), or alternatively, the polyurethane-containing component may comprise an interpenetrating network (IPN) or semi-IPN comprising at least two polymers (i.e., two polymer molecules with essentially no connecting chemical bonds), at least one urethane polymer and at least one vinyl polymer.

According to the present invention, the protective overcoat further comprises a polyvinyl alcohol having a weight average molecular weight and a degree of hydrolysis such that at least about 30 weight percent of the polyvinyl alcohol washes out during conventional photographic processing, for example RA processing. Suitably, the weight average molecular weight (MW) is less than or equal to about 150,000, with the proviso that if said molecular weight is greater than 100,000, then the degree of hydrolysis is less than 95%. It has been found that a polyvinyl alcohol meeting these limitations results in improved manufacturability and processability. In particular, the presence of the polyvinyl alcohol minimizes or prevents cracking of the overcoat during coating and drying and improves photographic-development kinetics.

The present invention is also directed to a method of making a photographic print using the above-described photographic element. In particular, the photographic element is developed in an alkaline developer solution having a pH greater than 7. This allows the developer to penetrate the protective coating. After the pH is reduced, for example in a bleach fix solution, the protective overcoat then becomes relatively water-resistant. The addition of polyvinyl alcohol, according to the present invention, facilitates this method. In particular, it has been found the selection of a specific type of polyvinyl alcohol provides improved wettability of the surface during processing and, at the same time, allows more of the polyvinyl alcohol to be washed out during the processing, so that the final product is more water-resistant. Although the processing-solution-permeable overcoat does not require fusing, optional fusing may improve the water-resistance further.

DESCRIPTION OF THE PREFERRED EMBODIMENTS

The present invention provides a simple and inexpensive way to improve the water-resistance of photographic elements. In accordance with the invention, the protective overcoat is applied over the photographic element prior to exposure and processing. In particular, in order to improve resistance to stains, spills or fingerprinting while maintaining processability, a special overcoat formulation is applied to the emulsion side of photographic products, particularly photographic prints, which may encounter frequent handling and abuse by end users. The photographic element comprises a support having thereon at least one light-sensitive layer and coated over the light-sensitive layer furthest from the support a continuous layer of polymer having an acid number greater than or equal to 5 and relatively permeable to water at a pH of greater than 7. Preferably, the acid number is less than or equal to 40, more preferably less than or equal to 30. Preferably, the pH of the developing solution is greater than 8, preferably greater than 9.

The overcoat formulation of the present invention is derived from polyurethane dispersions that provide advantageous properties such as good film-formation, good chemical-resistance, abrasion-resistance, toughness, elasticity and durability. Further, polyurethanes exhibit high levels of tensile and flexural strength and resistance to various oils.

The term "polyurethane-containing component" of the overcoat, as used herein, includes branched and unbranched copolymers, as well as IPN and semi-IPNs comprising at least two polymers, at least one of which is a polyurethane.

An IPN is an intimate combination of two or two or more polymers in a network, involving essentially(that may essentially involve) no covalent bonds or grafts between them. Instead, these intimate mixtures of polymers are held together by permanent entanglements produced when at least one of the polymers is synthesized in the presence of the other. Since there is usually molecular interpenetration of the polymers in IPNs, they tend to phase separate less compared to blends. Such interpenetrating polymer network systems and developments are described by L. H. Sperling in "Interpenetrating Polymer Networks and Related Materials," Plenum Press, New York, 1981, in pages 21–56 of "Multicomponent Polymer Materials" ACS Adv. In Chem. No. 211, edited by D. R. Paul and L. H. Sperling, ACS Books, Washington, D.C., 1986, and in pages 423–436 of "Comprehensive Polymer Science", Volume 6, "Polymer Reactions", edited by G. C. Eastmond, A. Ledwith, S. Russo, and P. Sigwalt, Pergamon Press, Elmsford, N.Y., 1989. While an ideal structure may involve optimal interpenetration, it is recognized that in practice phase separation may limit actual molecular interpenetration. Thus, an IPN may be described as having "interpenetrating phases" and/or "interpenetrating networks." If the synthesis or crosslinking of two or more of the constituent components is concurrent, the system may be designated a simultaneous interpenetrating network. If on the other hand, the synthesis and/or crosslinking are carried out separately, the system may be designated a sequential interpenetrating polymer network. A polymer system comprising two or more constituent polymers in intimate contact, wherein at least one is crosslinked and at least one other is linear is designated a semi-interpenetrating polymer network. For example, this type of polymer system has been formed in cured photopolymerizable systems such as disclosed in Chapter 7 of "Imaging Processes and Materials-Neblette's Eighth Edition," edited by J. M. Sturge, V. Walworth & A. Shepp, Van Nostrand Reinhold, New York, 1989.

In accordance with the present invention, the polyurethane-containing component of the overcoat contains pH responsive groups such as acid functionalities and have an acid number greater than or equal to 5, preferably less than or equal to 40, more preferably less than or equal to 30, most preferably from 10 to 25. The weight ratio of the urethane component in the polyurethane-containing component of the overcoat can vary from 20 to 100 percent. This includes a polyurethane (single) copolymer alone. The weight ratio of the optional vinyl polymer in the polymer can vary from 0 to 80 percent, including a interpenetrating network of a urethane polymer and a vinyl polymer if the amount of vinyl polymer is substantially greater than zero.

In one embodiment of the present invention, the polyurethane-containing component is an IPN or semi-IPN comprising a polyurethane and a vinyl polymer. By the term "vinyl polymer" is meant an addition polymer that is the reaction product of ethylenically unsaturated monomers. Particularly preferred vinyl polymers are acrylics. Vinyls, especially acrylics, have the added advantage of good adhesion, non-yellowing, are adjustable for high gloss, and have a wide range of glass transition and minimum film forming temperatures. Polymerization of vinyl monomers in the presence of the polyurethane copolymer causes the two polymers to reside in the same latex particle as an interpenetrating or semi-interpenetrating network particle resulting in improved resistance to water, organic solvents and environmental conditions, improved tensile strength, and modulus of elasticity. The presence of groups such as carboxylic acid groups provide a conduit for processing solutions to permeate the coating at pH greater than 7. Preferably, the acid number is maintained at less than or equal to 40 to ensure that overcoat has good adhesion to the substrate below, even at high pH, and makes the overcoat more water-resistant.

A preferred IPN comprises an interpenetrating polyurethane and vinyl polymer. Such an IPN is also sometimes referred to in the trade as a urethane-vinyl copolymer or hybrid copolymer, even though involving essentially no chemical bonds between the two polymer chains. Such an IPN may be conventionally produced by polymerizing one or more vinyl monomers in the presence of the polyurethane prepolymer or a chain extended polyurethane. It is possible to have more than two polymers or for each of the polymer chains to be branched or linear. Suitably, in such an IPN, the weight ratio of polyurethane component to vinyl component is 1:20 to 20:1. The preferred weight ratio of the polyurethane to the vinyl component is about 4:1 to about 1:4, more preferably about 1:1 to 1:4.

Coating compositions for forming the protective overcoat layer in accordance with the present invention comprise a continuous aqueous phase having therein a film-forming binder, wherein the binder comprises a polyurethane-containing component having an acid number of greater than or equal to 5, preferably less than or equal to 40, more preferably less than or equal to 30. Acid number is in general determined by titration and is defined as the number of milligrams of potassium hydroxide (KOH) required to neutralize 1 gram of the polymer.

Preparation of an aqueous dispersion of a polyurethane-containing component, when a single copolymer, is well known in the art. In a preferred method of preparation, the first step is the formation of a medium molecular weight isocyanate terminated prepolymer by the reaction of suitable di or polyol with a stoichiometric excess of di or polyisocyanates. The prepolymer is then generally dispersed in water via water-solubilizing/dispersing groups that are introduced either into the prepolymer prior to chain extension, or are introduced as part of the chain extension agent. Therefore, small particle size stable dispersions can frequently be produced without the use of an externally added surfactant. The prepolymer in the aqueous solution is then subjected to chain extension using diamines or diols to form the "fully reacted" polyurethane.

When a vinyl polymer is present in the polyurethane-containing component, such urethane-vinyl IPN copolymers may be produced, for example, by polymerizing one or more vinyl monomers in the presence of the polyurethane prepolymer or the chain extended polyurethane. The preferred weight ratio of the chain extended polyurethane to the vinyl monomer being about 4:1 to about 1:4, most preferably about 1:1 to 1:4, as mentioned above.

Polyols useful for the preparation of polyurethane dispersions of the present invention include polyester polyols prepared from one or more diols (e.g. ethylene glycol, butylene glycol, neopentyl glycol, hexane diol or mixtures of any of the above) and one or more dicarboxylic acids or anhydrides (succinic acid, adipic acid, suberic acid, azelaic acid, sebacic acid, phthalic acid, isophthalic acid, maleic acid and anhydrides of these acids), polylactone diols prepared from lactones such as caprolactone reacted with a diol, polyesteramides containing polyols prepared by inclusion of amino-alcohols such as ethanol amine during the polyesterification process, polyether polyols prepared from for example, ethylene oxide, propylene oxide or tetrahydrofuran, polycarbonate polyols prepared from reacting diols with diaryl carbonates, and hydroxyl terminated polyolefins prepared from ethylenically unsaturated monomers. Combinations of such polyols are also useful. As mentioned below, polysiloxane polyols are also useful in forming a polyurethane. See, for example, U.S. Pat. No. 5,876,9810 to Anderson, hereby incorporated by reference, for such monomers. A polyester polyol is preferred for the present invention.

Polyisocyanates useful for making the prepolymer may be aliphatic, aromatic or araliphatic. Examples of suitable polyisocyanates include one or more of the following: toluene diisocyanate, tetramethylene diisocyanate, hexamethylene diisocyanate, isophorone diisocyanate, ethylethylene diisocyanate, 2,3-dimethylethylene diisocyanate, 1-methyltrimethylene diisocyanate, 1,3-cyclopentylene diisocyanate, 1,4-cyclohexylene diisocyanate, 1,3-phenylene diisocyanate, 4,4'-biphenylene diisocyanate, 1,5-naphthalene diisocyanate, bis-(4-isocyanatocyclohexyl)-methane, 4,4'-diisocyanatodiphenyl ether, tetramethyl xylene diisocyanate, polymethylene polyphenyl polyisocyanates and the like. Methylene bis(isocyanato cyclohexane) is preferred.

Preferably, a suitable portion of the prepolymer also contains at least one comparatively unreactive pendant carboxylic group, in salt form or preferably neutralized with a suitable basic material to form a salt during or after prepolymer formation or during formation of the dispersion. This helps provide permeability of processing solutions through the overcoat at pHs greater than 7 and dispersibility in water. Suitable compounds that are reactive with the isocyanate groups and have a group capable of forming an anion include, but are not limited to the following: dihydroxypropionic acid, dimethylolpropionic acid, dihydroxysuccinic acid and dihydroxybenzoic acid. Other suitable compounds are the polyhydroxy acids which can be prepared by oxidizing monosaccharides, for example gluconic acid, saccharic acid, mucic acid, glucuronic acid and the like. Such a carboxylic-containing reactant is preferably an $\alpha,\alpha$-dimethylolalkanoic acid, especially 2,2-dimethylol propionic acid.

Suitable tertiary amines which may be used to neutralize the acid and form anionic groups for water dispersability are trimethylarnine, triethylamine, dimethylaniline, diethylaniline, triphenylamine and the like.

Chain extenders suitable for optionally chain extending the prepolymer are, for example, active-hydrogen containing molecules such as polyols, amino alcohols, ammonia, primary or secondary aliphatic, aromatic, alicyclic araliphatic or heterocyclic amines especially diamines. Diamines suitable for chain extension of the pre- polyurethane include ethylenediamine, diaminopropane, hexamethylene diamine, hydrazine, aminoethyl ethanolamine and the like.

In accordance with one embodiment of this invention, a urethane-vinyl IPN may be prepared by polymerizing vinyl addition monomers in the presence of the polyurethane prepolymer or the chain extended polyurethane. The solution of the water-dispersible polyurethane prepolymer in vinyl monomer may be produced by dissolving the prepolymer in one or more vinyl monomers before dispersing the prepolymer in water.

Suitable vinyl monomers in which the prepolymer may be dissolved contain one or more polymerizable ethylenically unsaturated groups. Preferred monomers are liquid under the temperature conditions of prepolymer formation, although the possibility of using solid monomers in conjunction with organic solvents is not excluded.

The vinyl polymers useful for the present invention include those obtained by copolymerizing one or more ethylenically unsaturated monomers including, for example, alkyl esters of acrylic or methacrylic acid such as methyl methacrylate, ethyl methacrylate, butyl methacrylate, ethyl acrylate, butyl acrylate, hexyl acrylate, n-octyl acrylate, lauryl methacrylate, 2-ethylhexyl methacrylate, nonyl acrylate, benzyl methacrylate, the hydroxyalkyl esters of the same acids such as 2-hydroxyethyl acrylate, 2-hydroxyethyl methacrylate, and 2-hydroxypropyl methacrylate, the nitrile and amides of the same acids such as acrylonitrile, methacrylonitrile, and methacrylamide, vinyl acetate, vinyl propionate, vinylidene chloride, vinyl chloride, and vinyl aromatic compounds such as styrene, t-butyl styrene and vinyl toluene, dialkyl maleates, dialkyl itaconates, dialkyl methylene-malonates, isoprene, and butadiene. Suitable ethylenically unsaturated monomers containing carboxylic acid groups include acrylic monomers such as acrylic acid, methacrylic acid, ethacrylic acid, itaconic acid, maleic acid, fumaric acid, monoalkyl itaconate including monomethyl itaconate, monoethyl itaconate, and monobutyl itaconate, monoalkyl maleate including monomethyl maleate, monoethyl maleate, and monobutyl maleate, citraconic acid, and styrene carboxylic acid. Suitable polyethylenically unsaturated monomers include butadiene, isoprene, allylmethacrylate, diacrylates of alkyl diols such as butanediol diacrylate and hexanediol diacrylate, divinyl benzene and the like.

The prepolymer/vinyl monomer solution may be dispersed in water using techniques well known in the art. Preferably, the solution is added to water with agitation or, alternatively, water may be stirred into the solution. Polymerization of the vinyl monomer or monomers is brought about by free radical initiators at elevated temperatures.

Free radicals of any sort may be used including persulfates (such as ammonium persulfate, potassium persulfate, etc., peroxides (such as hydrogen peroxide, benzoyl peroxide, cumene hydroperoxide, tertiary butyl peroxide, etc.), azo compounds (such as azobiscyanovaleric acid, azoisobutyronitrile, etc.), and redox initiators (such as hydrogen peroxide-iron(II) salt, potassium persulfate-sodium hydrogen sulfate, etc.). Preferable free radical initiators are the ones that partition preferably into the oil phase such as the azo-type initiators. Common chain transfer agents or mixtures thereof known in the art, such as alkylmercaptans, can be used to control the polymer molecular weight.

Polymerization may be carried out by various methods. In one method, all of the vinyl monomer (the same or different vinyl monomers or monomer mixtures) is added in order to swell the polyurethane prepolymer. The monomers are then polymerized using an oil soluble free radical initiator after dispersing the mixture in water.

In a second alternative method, some of vinyl monomer may be added to swell the pre-polymer prior to dispersing in water. The rest of the monomer is fed into the system during the polymerization process. Other methods include feeding in all the vinyl monomer during the copolymerization process.

Some examples of polyurethane-containing components used in the practice of this invention that are commercially available include NeoPac® R-9000, R-9699 and R-9030 from NeoResins (Wilmington, Del.), Sancure® AU4010 from BF Goodrich (Akron, Ohio), and Flexthane® 620, 630, 790 and 791 from Air Products. An example of the polyurethane-containing copolymer useful in the practice that is commercially available is the NeoRez® R9679.

In accordance with this invention, the protective overcoat comprises, in addition to the pH switchable polymer described above, a selected water-soluble polyvinyl alcohol. The selected polyvinyl alcohol yields coatings that are free of cracks and do not significantly reduce the diffusion rate of the developer with the underlying emulsions. At the same time, the use of the selected polyvinyl alcohol improves the water resistance of the final product.

The term "polyvinyl alcohol" referred to herein means a polymer having a monomer unit of vinyl alcohol as a main component. Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, "World of PVA", Edited by the Poval Society and Published by Kobunshi Kankoukai, Japan, 1992 and "Poval", Edited by Nagano et al. and Published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 90% refers to polymers in which 90 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers.

As indicated above, polyvinyl alcohols are most typically produced by hydrolysis of polyvinyl acetate polymers. The degree of hydrolysis affects a number of physical properties, including water resistance and durability in subtle and unexpected ways, particular in the context of an overcoat according to the present invention. Polyvinyl alcohols are commercially available from a variety of sources in a variety of grades and degrees of hydrolysis, and molecular weights or degrees of polymerization. The polymerization of vinyl acetate can be conducted in any known manner without particular restriction. Usually, the polymerization is conducted in a solution polymerization manner employing as the solvent an alcohol such as methanol, ethanol or isopropanol. Of course, an emulsion polymerization and suspension polymerization may also be adopted. In such a solution polymerization, vinyl acetate monomer may be fed at one time, continuously, intermittently or in any other manner. The solution polymerization is conducted in the presence of azobisisobutyronitrile, acetyl peroxide, benzoyl peroxide, lauroyl peroxide or other known radical polymerization catalysts. The polymerization temperature is selected from about 50° C. to the boiling point of the reaction mixture. Vinyl acetate may be polymerized alone, or may be copolymerized with other monomers copolymerizable with vinyl acetate, e.g. an unsaturated carboxylic acid or its alkyl ester, such as acrylic acid, methacrylic acid, crotonic acid, maleic acid or a monoalkyl maleate; a nitrile such as acrylonitrile or methacrylonitrile, an amide such as acrylamide methacrylamide; an olefinsulfonic acid or its salt such as ethylenesulfonic acid, allylsulfonic acid or methallylsulfonic acid; a vinyl ester other than vinyl acetate; a vinyl ester of a saturated branched fatty acid; a vinyl ether; a vinyl ketone; an alpha -olefin; a vinyl halide; a vinylidene halide; or the like. The amount of the other copolymerizable monomers is usually at most 10% by mole, preferable at most 5% by mole.

The hydrolysis of a vinyl acetate polymer may be conducted by dissolving the vinyl acetate polymer in an alcohol and adding an alkali catalyst or an acid catalyst to the solution. As an alcohol are used, for example, methanol, ethanol and butanol. The concentration of the vinyl acetate polymer in the alcohol solution is from 20 to 50% by weight. Examples of the alkali catalyst are, for instance sodium hydroxide, potassium hydroxide, sodium methylate, sodium ethylate, potassium methylate, and other alkali metal hydroxides or alcoholates. Examples of the acid catalyst are, for instance, an inorganic acid such as hydrochloric acid or sulfuric acid, and an organic acid such as p-toluene sulfonic acid. The amount of such a catalyst is needed to be 1 to 100 millimole equivalents to vinyl acetate unit. The hydrolysis temperature is not particularly limited, but usually selected from 10° to 70° C., preferably from 30° to 40° C. The reaction is usually conducted for 2 to 3 hours.

The present invention involves the use, in combination with the urethane polymer in the protective coat, of a polyvinyl alcohol having a weight average molecular weight (MW) of less than 150,000, preferably less than 100,000, and a degree of hydrolysis greater than 70%, with the proviso that if the MW is greater than 100,000, the degree of hydrolysis is less than 95%, preferably not more than 90%. On the other hand, if the MW is less than 100,000, the degree of hydrolysis may be equal to or greater than 95%, up to 100%. Preferably, the degree of hydrolysis is 85 to 90% for a polyvinyl alcohol having a MW of 25,000 to 75,000. It has been found that a polyvinyl alcohol meeting these limitations results in improved manufacturability and processability. In particular, the presence of such a polyvinyl alcohol minimizes or prevents cracking of the overcoat during coating and drying, improves photographic development kinetics, and washes out of the coating efficiently during processing. The polyvinyl alcohol is selected to make the coating wettable, readily processable, and in a substantial amount, to readily, not sluggishly, come out of the coating during processing, thereby yielding the final water-resistant product.

In one preferred embodiment of the invention, the polyvinyl alcohol is present in the overcoat in the amount between 1 and 60 weight percent of the polyurethane-containing copolymer, preferably between 5 and 50 weight percent of the polyurethane-vinyl copolymer, most preferably between 10 and 45 weight percent of the polyurethane-containing copolymer. The optimal amount of polyvinyl alcohol depends on the amount of dry coverage of polyurethane-containing component. For example, if coverage of the polyurethane-containing copolymer is 1.08 $g/m^2$ (100 $mg/ft^2$) or less, then about 20% or less of the polyvinyl alcohol, by weight of the polyurethane-containing component, provides good results, whereas for higher coverage, for example (1.88 $g/m^2$) 175 $mg/ft^2$, greater than about 25% of the polyvinyl alcohol provides comparably good results.

As mentioned above, the use in the protective overcoat, of the selected polyvinyl alcohol results in improved manufacturability and process ability. In particular, the presence of the polyvinyl alcohol minimizes or prevents cracking of the overcoat during coating and drying and, at the same time, improves photographic development kinetics. Furthermore, the amount of PVA washed out in the processing of a photographic element increases, such that enhanced water resistance of the final product is obtained.

Other polymers, in addition to polyurethane-containing polymer and polyvinyl alcohol, may optionally be present, suitably in amounts up to about to 25 weight percent by weight of the polyurethane containing component. For example, examples of optional additional water-soluble polymers that may be added include cellulose ethers and their derivatives, n-vinyl amides, functionalized polyesters, poly(ethylene oxide), starch, proteins including gelatin, whey and albumin, poly(acrylic acid) and its homologs, alginates, gums, and the like. Such materials are included in "Handbook of Water-Soluble Gums and Resins" by Robert l. Davidson (McGraw-Hill Book Company, 1980) or "Organic Colloids" by Bruno Jirgensons (Elsvier Publishing Company, 1958).

Optional non-water-soluble polymers may be used to supplement the polyurethane-containing component include, for example, polyvinyl chloride and the like in U.S. Pat. No. 5,853,926 to Bohan et al.

Optionally, the coating composition in accordance with the invention may also contain suitable crosslinking agents for crosslinking the acid groups in the polyurethane-containing component. Such an additive can improve the adhesion of the overcoat layer to the substrate below as well as contribute to the cohesive strength of the layer. Crosslinkers such as epoxy compounds, polyfunctional aziridines, methoxyalkyl melamines, triazines, polyisocyanates, carbodiimides, polyvalent metal cations, and the like may all be considered. If a crosslinker is added, care must be taken that excessive amounts are not used as this will decrease the permeability of the processing solution. The crosslinker may be added to the mixture of polyurethane-containing component and any additional polymers. The preferred crosslinker is a polyfunctional aziridine crosslinker.

The polymer overcoat should be clear, i.e., transparent, and is preferably colorless. But it is specifically contemplated that the polymer overcoat can have some color for the purposes of color correction, or for special effects, so long as it does not detrimentally affect the formation or viewing of the image through the overcoat. Thus, there can be incorporated into the polymer a dye that will impart color or tint. In addition, additives can be incorporated into the polymer that will give the overcoat various desired properties. For example, a UV absorber may be incorporated into the polymer to make the overcoat UV absorptive, thus protecting the image from UV induced fading. Other compounds may be added to the coating composition, depending on the functions of the particular layer, including surfactants, emulsifiers, coating aids, lubricants, matte particles, rheology modifiers, crosslinking agents, antifoggants, inorganic fillers such as conductive and nonconductive metal oxide particles, pigments, magnetic particles, biocide, and the like. The coating composition may also include a small amount of organic solvent, preferably the concentration of organic solvent is less than 1 percent by weight of the total coating composition. The invention does not preclude coating the desired polymeric material from a volatile organic solution or from a melt of the polymer.

Examples of coating aids include surfactants, viscosity modifiers and the like. Surfactants include any surface-active material that will lower the surface tension of the coating preparation sufficiently to prevent edge-withdrawal, repellencies, and other coating defects. These include alkyloxy- or alkylphenoxypolyether or polyglycidol derivatives and their sulfates, such as nonylphenoxypoly(glycidol) available from Olin Matheson Corporation or sodium octylphenoxypoly(ethyleneoxide) sulfate, organic sulfates or sulfonates, such as sodium dodecyl sulfate, sodium dodecyl sulfonate, sodium bis(2-ethylhexyl)sulfosuccinate (Aerosol OT), and alkylcarboxylate salts such as sodium decanoate.

The surface characteristics of the overcoat are in large part dependent upon the physical characteristics of the polymers which form the continuous phase and the presence or absence of solid, nonfusible particles. However, the surface characteristics of the overcoat also can be modified by the conditions under which the surface is optionally fused. For example, in contact fusing, the surface characteristics of the fusing element that is used to fuse the polymers to form the continuous overcoat layer can be selected to impart a desired degree of smoothness, texture or pattern to the surface of the element. Thus, a highly smooth fusing element will give a glossy surface to the imaged element, a textured fusing element will give a matte or otherwise textured surface to the element, a patterned fusing element will apply a pattern to the surface of the element, etc.

Matte particles well known in the art may also be used in the coating composition of the invention, such matting agents have been described in *Research Disclosure* No. 308119, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include hydroxyl, carboxyl, carbodiimide, epoxide, aziridine, vinyl sulfone, sulfinic acid, active methylene, amino, amide, allyl, and the like.

In order to reduce the sliding friction of the photographic elements in accordance with this invention, the urethane-vinyl copolymers may contain fluorinated or siloxane-based components and/or the coating composition may also include lubricants or combinations of lubricants. Typical lubricants include (1) silicone based materials disclosed, for example, in U.S. Pat. Nos. 3,489,567, 3,080,317, 3,042,522, 4,004,927, and 4,047,958, and in British Patent Nos. 955, 061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc., disclosed in U.S. Pat. Nos. 2,454,043; 2,732,305; 2,976,148; 3,206,311; 3,933,516; 2,588,765; 3,121,060; 3,502,473; 3,042,222; and 4,427,964, in British Patent Nos. 1,263,722; 1,198,387; 1,430,997; 1,466,304; 1,320,757; 1,320,565; and 1,320,756; and in German Patent Nos. 1,284,295 and 1,284, 294; (3) liquid paraffin and paraffin or wax like materials such as carnauba wax, natural and synthetic waxes, petroleum waxes, mineral waxes, silicone-wax copolymers and the like; (4) perfluoro- or fluoro- or fluorochloro-containing materials, which include poly(tetrafluoroethylene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in *Research Disclosure* No.308119, published December 1989, page 1006.

The support material used with this invention can comprise various polymeric films, papers, glass, and the like. The thickness of the support is not critical. Support thicknesses of 2 to 15 mils (0.002 to 0.015 inches) can be used. Biaxially oriented support laminates can be used with the present invention. These supports are disclosed in commonly owned U.S. Pat. Nos. 5,853,965, 5,866,282, 5,874, 205, 5,888,643, 5,888,681, 5,888,683, and 5,888,714, incorporated in their entirety by reference herein. These supports include a paper base and a biaxially oriented polyolefin sheet, typically polypropylene, laminated to one or both sides of the paper base. At least one photosensitive silver halide layer is applied to the biaxially oriented polyolefin sheet.

The coating composition of the invention can be applied by any of a number of well known techniques, such as dip coating, rod coating, blade coating, air knife coating, gravure coating and reverse roll coating, extrusion coating, slide coating, curtain coating, and the like. After coating, the layer is generally dried by simple evaporation, which may be accelerated by known techniques such as convection heating. Known coating and drying methods are described in further detail in *Research Disclosure* No. 308119, Published December 1989, pages 1007 to 1008. Preferably, a commercial embodiment involve simultaneous co-extrusion.

The laydown of the overcoat will depend on its field of application. For a photographic element, the laydown of the polyurethane-containing copolymer is suitably at least 0.54 $g/m^2$ (50 $mg/ft^2$), preferably 1.08 to 5.38 $g/m^2$ (100 to 500 $mg/ft^2$), most preferably 1.61 to 3.23 $g/m^2$ (150 to 300 $mg/ft^2$). It may be advantageous to increase the amount of polyvinyl alcohol in the overcoat as the laydown increases in order to improve the developability.

After applying the coating composition to the support, it may be dried over a suitable period of time, for example 2 to 4 minutes. In the event of cracking, especially at lower levels of polyvinyl alcohol or when using an alternative film-forming polymer, it may be advantageous to adjust the temperature and/or humidity of the drying step to eliminate or reduce this cracking problem. Without wishing to be bound by theory, it is believed that higher levels of polyvinyl alcohol with limited degree of hydrolysis reduces the tendency of the polyvinyl alcohol to block the release of water during drying, which might otherwise occur with overly fast film formation and drying. Thus, polyvinyl alcohol according to one embodiment of the invention, by delaying film formation allows the release of water during drying which if blocked might otherwise adversely affect the uniformity of the overcoat.

Photographic elements can contain conductive layers incorporated into multilayer photographic elements in any of various configurations depending upon the requirements of the specific photographic element. Preferably, the conductive layer is present as a subbing or tie layer underlying a magnetic recording layer on the side of the support opposite the photographic layer(s). However, conductive layers can be overcoated with layers other than a transparent magnetic recording layer (e.g., abrasion-resistant backing layer, curl control layer, pelloid, etc.) in order to minimize the increase in the resistivity of the conductive layer after overcoating. Further, additional conductive layers also can be provided on the same side of the support as the photographic layer(s) or on both sides of the support. An optional conductive subbing layer can be applied either underlying or overlying a gelatin subbing layer containing an antihalation dye or pigment. Alternatively, both antihalation and antistatic functions can be combined in a single layer containing conductive particles, antihalation dye, and a binder. Such a hybrid layer is typically coated on the same side of the support as the sensitized emulsion layer. Additional optional layers can be present as well. An additional conductive layer can be used as an outermost layer of an photographic element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the photographic layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers underlying a transparent magnetic recording layer typically exhibit an internal resistivity of less than $1\times10^{10}$ ohms/square, preferably less than $1\times10^{9}$ ohms/square, and more preferably, less than $1\times10^{8}$ ohms/square.

Photographic elements of this invention can differ widely in structure and composition. For example, the photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure,* Item 36230 (June 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure,* Vol. 176, Item 17643 (December, 1978).

Photographic elements protected in accordance with this invention may be derived from silver-halide photographic elements that can be black and white elements (for example, those which yield a silver image or those which yield a neutral tone image from a mixture of dye forming couplers), single color elements or multicolor elements. Multicolor elements typically contain dye image-forming units sensitive to each of the three primary regions of the spectrum. The imaged elements can be imaged elements which are viewed by transmission, such a negative film images, reversal film images and motion-picture prints or they can be imaged elements that are viewed by reflection, such a paper prints. Because of the amount of handling that can occur with paper prints and motion picture prints, they are the preferred imaged photographic elements for use in this invention.

While a primary purpose of applying an overcoat to imaged elements in accordance with this invention is to protect the element from physical damage, application of the overcoat may also protect the image from fading or yellowing. This is particularly true with elements that contain images that are susceptible to fading or yellowing due to the action of oxygen. For example, the fading of dyes derived from pyrazolone and pyrazoloazole couplers is believed to be caused, at least in part, by the presence of oxygen, so that the application of an overcoat which acts as a barrier to the passage of oxygen into the element will reduce such fading.

Photographic elements in which the images to be protected are formed can have the structures and components shown in Research Disclosures 37038 and 38957. Other structures which are useful in this invention are disclosed in commonly owned U.S. Ser. No. 09/299,395, filed Apr. 26, 1999 and U.S. Ser. No. 09/299,548, filed Apr. 26, 1999, incorporated in their entirety by reference. Specific photographic elements can be those shown on pages 96–98 of Research Disclosure 37038 as Color Paper Elements 1 and 2. A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

The photographic element can contain additional layers, such as filter layers, interlayers, overcoat layers, subbing layers, and the like. All of these can be coated on a support that can be transparent (for example, a film support) or reflective (for example, a paper support). Photographic elements protected in accordance with the present invention may also include a magnetic recording material as described in *Research Disclosure,* Item 34390, November 1992, or a transparent magnetic recording layer such as a layer containing magnetic particles on the underside of a transparent support as described in U.S. Pat. No. 4,279,945 and U.S. Pat. No. 4,302,523.

Suitable silver-halide emulsions and their preparation, as well as methods of chemical and spectral sensitization, are described in Sections I through V of Research Disclosures 37038 and 38957. Others are described in U.S. Ser. No. 09/299,395, filed Apr. 26, 1999 and U.S. Ser. No. 09/299,548, filed Apr. 26, 1999, which are incorporated in their entirety by reference herein. Color materials and development modifiers are described in Sections V through XX of Research Disclosures 37038 and 38957. Vehicles are described in Section II of Research Disclosures 37038 and 38957, and various additives such as brighteners, antifoggants, stabilizers, light absorbing and scattering materials, hardeners, coating aids, plasticizers, lubricants and matting agents are described in Sections VI through X and XI through XIV of Research Disclosures 37038 and 38957. Processing methods and agents are described in Sections XIX and XX of Research Disclosures 37038 and 38957, and methods of exposure are described in Section XVI of Research Disclosures 37038 and 38957.

Photographic elements typically provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like). Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like.

Photographic elements can be imagewise exposed using a variety of techniques. Typically exposure is to light in the visible region of the spectrum, and typically is of a live image through a lens. Exposure can also be to a stored image (such as a computer stored image) by means of light emitting devices (such as LEDs, CRTs, etc.).

Images can be developed in photographic elements in any of a number of well known photographic processes utilizing any of a number of well known processing compositions, described, for example, in T. H. James, editor, *The Theory of the Photographic Process,* 4th Edition, Macmillan, New York, 1977. In the case of processing a color negative element, the element is treated with a color developer (that is one which will form the colored image dyes with the color couplers), and then with an oxidizer and a solvent to remove silver and silver halide. In the case of processing a color reversal element, the element is first treated with a black and white developer (that is, a developer which does not form colored dyes with the coupler compounds) followed by a treatment to render developable unexposed silver halide (usually chemical or light fogging), followed by treatment with a color developer. Development is followed by bleach-fixing, to remove silver or silver halide, washing and drying.

In one embodiment of a method of using a composition according to the present invention, a photographic element may be provided with a processing-solution-permeable overcoat having the above described composition overlying the silver halide emulsion layer superposed on a support. The photographic element is developed in an alkaline developer solution having a pH greater than 7, preferably greater than 8, more preferably greater than 9. This allows the developer to penetrate the protective coating. After the pH is reduced, for example in a bleach fix solution, the protective overcoat becomes relatively water resistant. The addition of polyvinyl alcohol, according to one embodiment of the present invention, facilitates this method. It has been found the polyvinyl alcohol can provide improved wettability of the surface during processing and, at the same time, allows more of the polyvinyl alcohol to be washed out during the processing, so that the final product is more water resistant. Suitably at least 30%, preferably greater than 50%, more preferably greater than 75% of the original amount of PVA in the overcoat is washed out during processing of the exposed photographic element, such that the final product is depleted in hydrophilic polymer and hence relatively more water resistant. Although the processing-solution-permeable overcoat does not require fusing, optional fusing may improve the water resistance further The overcoat layer in accordance with this invention is particularly advantageous for use with photographic prints due to superior physical properties including excellent resistance to water-based spills, fingerprinting, fading and yellowing, while providing exceptional transparency and toughness necessary for providing resistance to scratches, abrasion, blocking, and ferrotyping. The polymer overcoat may be further coalesced by fusing (heat and/or pressure) if needed after processing without substantial change or addition of chemicals in the processing step to form a fully water impermeable protective overcoat with excellent gloss characteristics. Optional fusing may be carried out at a temperature of from 25 to 175° C., or lower for pressure fusing.

The present invention is illustrated by the following examples. Unless otherwise indicated, the molecular weights herein are weight average molecular weights, as determined by size exclusion chromotagraphy described below.

EXAMPLES

A urethane-acrylic "copolymer" (an interpenetrating network of two polymers) designated P1 was synthesized as described below. The polymer has an acid number of 11. The polyvinyl alcohols (PVA) tested were as follows: VI (Airvol® 203),V2 (Airvol® 205) and C3 (Airvol® 523) obtained from Air Products which were 87 to 89% hydrolyzed (by hydrolyzed is meant that the acetate groups in the monomeric units are converted to hydroxy groups); V4, 88% hydrolyzed purchased from Acros Organics (N.J.); V5, V6, C7 and C8 purchased from Aldrich which were 98–99% hydrolyzed; and V9 also purchased from Aldrich which was 80% hydrolyzed. The average molecular weights of all the PVAs are shown in Table 3 below. A crosslinker for the acid containing urethane-vinyl copolymers, CX 100 (a polyfunctional aziridine), was obtained from Neo Resins (a division of Avecia).

Synthesis of Polymer P1

Into a dry reactor was charged 96 grams of a diol (Millester® 9–55, MW2000 from Polyurethane Corporation of America), 87 grams of the methylene bis(4-cyclohexyl) isocyanate (Desmodur®W) and 0.02 grams of dibutyltin dilaurate (Aldrich). The mixture was held with stirring for 90 minutes at 94° C. under a blanket of argon after which 14 grams of dimethylol propionic acid was added to the reactor and the mixture stirred for 1.5 hours at 94° C. At this point 24 grams of methyl methacrylate were added and stirred for 1 hour at the same temperature. The resultant prepolymer was cooled to below 40° C., dissolved in a vinyl monomer mixture consisting of 113 grams of n-butyl acrylate, 183 grams of methyl methacrylate, and 5 grams of acetoacetoxyethyl methacrylate, and then treated with 11 grams of triethylamine and 2.5 grams of initator (AIBN). To this mixture was added 1000 ml deoxygenated water followed by 10 grams of ethylene diamine in 20 grams of water. The dispersion was heated to 65° C., held there with stirring for 2 hours and heated further to 80° C. for 10 hours. The resulting dispersion of the urethane acrylic copolymer was used as polymer P1 having an acid number of 11.

All the protective overcoats were coated over paper that was previously coated with light sensitive emulsions according to the formulation described below in Tables 1 and 2. In some instances the coatings were made directly over layer 6. The gelatin-containing layers were hardened with bis (vinylsulfonyl methyl) ether at 1.95% of the total gelatin weight.

TABLE 1

| | | Laydown (g/m2) |
|---|---|---|
| Layer 7 | Overcoat | |
| | Gelatin | 0.6456 |
| | Ludox AM ™(colloidal silica) | 0.1614 |
| | Polydimethylsiloxane (DC200 ™) | 0.0202 |
| | 5-chloro-2-methyl-4-isothiazolin-3-one/2-methyl-4-isothiazolin-3-one (3/1) | 0.0001 |
| | SF-2 | 0.0032 |
| | Tergitol 15-S-5 ™(surfactant) | 0.0020 |
| | SF-1 | 0.0081 |
| | Aerosol OT ™(surfactant) | 0.0029 |
| Layer 6 | UV Layer | |
| | Gelatin | 0.8231 |
| | UV-1 | 0.0355 |
| | UV-2 | 0.2034 |
| | ST-4 | 0.0655 |
| | SF-1 | 0.0125 |
| | S-6 | 0.0797 |
| | 5-chloro-2-methyl-4-isothiazolin-3-one/2-methyl-4-isothiazolin-3-one (3/1) | 0.0001 |
| Layer 5 | Red Sensitive Layer | |
| | Gelatin | 1.3558 |
| | Red Sensitive silver (Red EM-1) | 0.1883 |
| | IC-35 | 0.2324 |
| | IC-36 | 0.0258 |

TABLE 1-continued

| | | Laydown (g/m2) |
|---|---|---|
| | UV-2 | 0.3551 |
| | Dibutyl sebacate | 0.4358 |
| | S-6 | 0.1453 |
| | Dye-3 | 0.0229 |
| | Potassium p-toluenethiosulfonate | 0.0026 |
| | 5-chloro-2-methyl-4-isothiazolin-3-one/2-methyl-4-isothiazolin-3-one (3/1) | 0.0001 |
| | Sodium Phenylmercaptotetrazole | 0.0005 |
| | SF-1 | 0.0524 |
| Layer 4 | M/C Interlayer | |
| | Gelatin | 0.7532 |
| | ST-4 | 0.1076 |
| | S-3 | 0.1969 |
| | Acrylamide/t-Butylacrylamide sulfonate copolymer | 0.0541 |
| | Bis-vinylsulfonylmethane | 0.1390 |
| | 3,5-Dinitrobenzoic acid | 0.0001 |
| | Citric acid | 0.0007 |
| | Catechol disulfonate | 0.0323 |
| | 5-chloro-2-methyl-4-isothiazolin-3-one/2-methyl-4-isothiazolin-3-one (3/1) | 0.0001 |
| Layer 3 | Green Sensitive Layer | |
| | Gelatin | 1.1944 |
| | Green Sensitive silver (Green EM-1) | 0.1011 |
| | M-4 | 0.2077 |
| | Oleyl Alcohol | 0.2174 |
| | S-3 | 0.1119 |
| | ST-21 | 0.0398 |
| | ST-22 | 0.2841 |
| | Dye-2 | 0.0073 |
| | 5-chloro-2-methyl-4-isothiazolin-3-one/2-methyl-4-isothiazolin-3-one (3/1) | 0.0001 |
| | SF-1 | 0.0236 |
| | Potassium chloride | 0.0204 |
| | Sodium Phenylmercaptotetrazole | 0.0007 |
| Layer 2 | Interlayer | |
| | Gelatin | 0.7532 |
| | ST-4 | 0.1076 |
| | S-3 | 0.1969 |
| | 5-chloro-2-methyl-4-isothiazolin-3-one/2-methyl-4-isothiazolin-3-one (3/1) | 0.0001 |
| | Catechol disulfonate | 0.0323 |
| | SF-1 | 0.0081 |
| Layer 1 | Blue Sensitive Layer | |
| | Gelatin | 1.3127 |
| | Blue sensitive silver (Blue BM-1) | 0.2399 |
| | Y-4 | 0.4143 |
| | ST-23 | 0.4842 |
| | Tributyl Citrate | 0.2179 |
| | ST-24 | 0.1211 |
| | ST-16 | 0.0095 |
| | Sodium Phenylmercaptotetrazole | 0.0001 |
| | Piperidino hexose reductone | 0.0024 |
| | 5-chloro-2-methyl-4-isothiazolin-3-one/2-methyl-4-isothiazolin-3-one (3/1) | 0.0002 |
| | SF-1 | 0.0366 |
| | Potassium chloride | 0.0204 |
| | Dye-1 | 0.0148 |

Photographic paper support
TABLE 2
IC-35
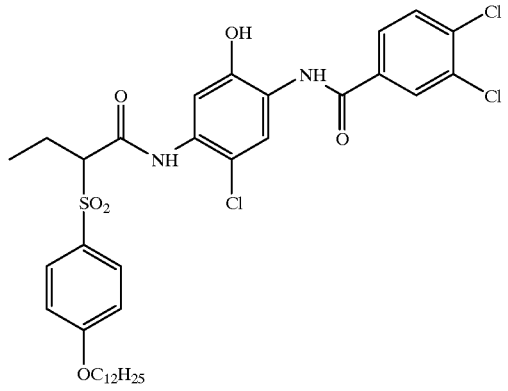
IC-36
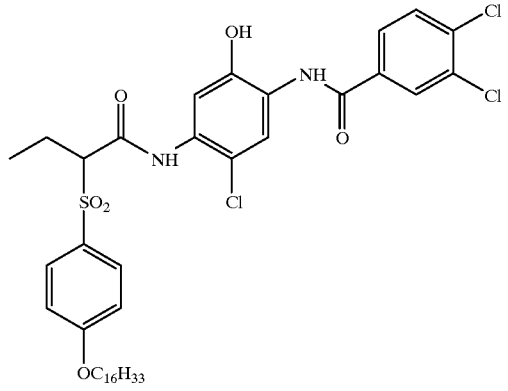
M-4
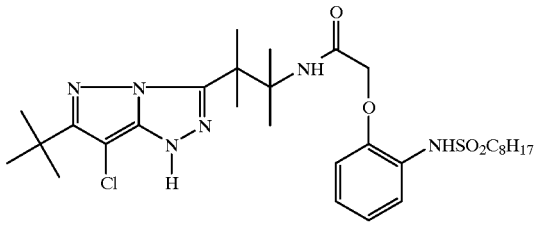
Y-4
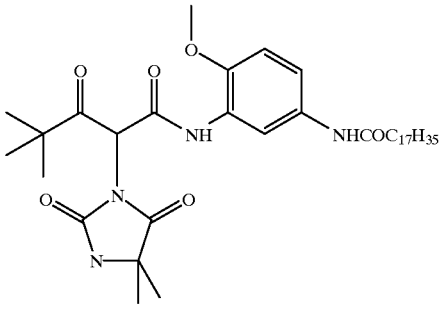

TABLE 2-continued
Dye-1
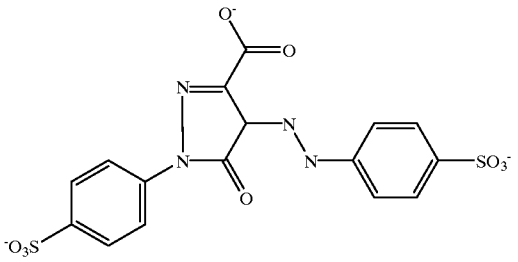
Dye-2
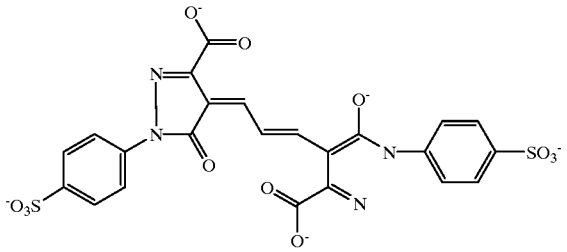
Dye-3
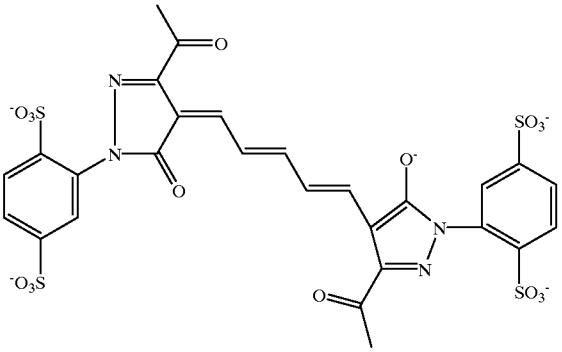
S-3 Diundecyl phthalate
S-6 Tris(2-ethylhexyl)phosphate
ST-4
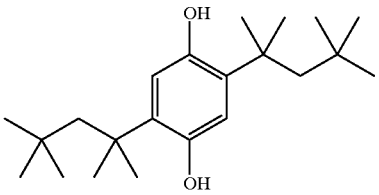
ST-16
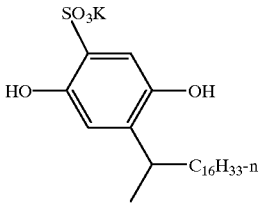
ST-21
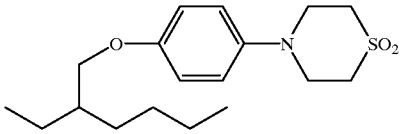

TABLE 2-continued

| | |
|---|---|
| ST-22 | 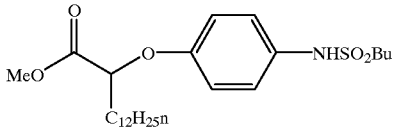 |
| ST-23 | 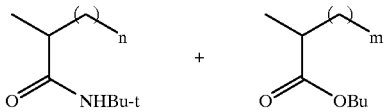 |
| ST-24 | 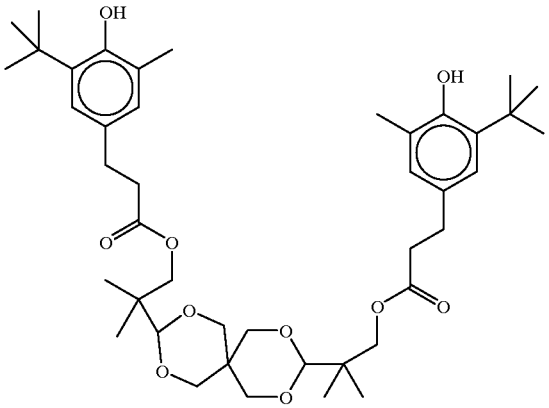 |
| SF-1 | 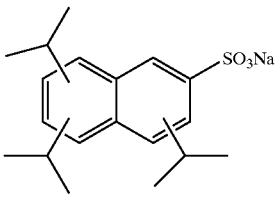 |
| SF-2 | $CF_3.(CF_2)_7.SO_3Na$ |
| UV-1 | 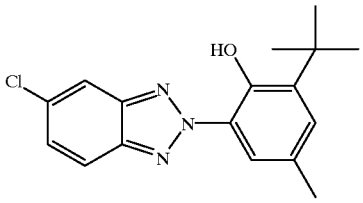 |
| UV-2 | 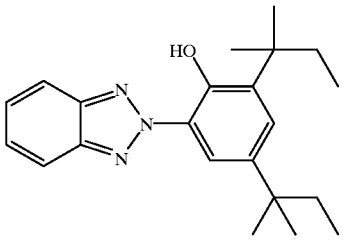 |

Measurement of Molecular Weights

Weight average molecular weights reported are derived from the pullulan equivalent molecular weight distributions for the samples. The samples were analyzed by size-exclusion chromatography (SEC) in dimethyl sulfoxide (DMSO) containing 0.01M lithium nitrate using one Jordi Gel GBR mixed-bed column. The column set was calibrated with narrow-molecular-weight distribution pullulan standards between MW 5,900 (log M=3.77) and MW 788,000 (log M=5.90). Results were plotted as pullulan equivalent molecular weights and the number average ($M_n$), weight average ($M_w$), and z-average ($M_z$), molecular weights were determined from each plot. The ordinate "Wn (logM)" on the plots were considered proportional to the weight fraction of polymer at a given molecular weight on a logarithmic scale. Distributions and molecular weight averages were not corrected for axial dispersion.

The measured weight average molecular weights of the PVAs and also the manufacturer's estimated average molecular weights are listed in Table 3 below. The manufacturer's average molecular weights may be based on commericial production sampling. In the absence of manufacturer's specification, these molecular weights may or may not correspond to number average molecular weights. The disparity between number average molecular weights and weight average molecular weights indicate that the PVAs have a broad molecular weight distribution, including a substantial amount of higher molecular weight species within the range of molecular weights.

TABLE 3

| PVA | Manufacturer's Average Molecular Weight X1000 | Measured Number Average Molecular WeightX1000 | Measured Weight Average Molecular Weight x 1000 |
|---|---|---|---|
| V1 | 13–23 | 15 | 42 |
| V2 | 31–50 | 20 | 66 |
| C3 | 85–146 | 58 | 167 |
| V4 | 22 | 12 | 55 |
| V5 | 13–23 | 13 | 39 |
| V6 | 31–50 | 18 | 58 |
| C7 | 81–146 | 54 | 172 |
| C8 | 124–186 | 95 | 231 |
| V9 | 9–10 | 12 | 35 |

Test for Dye-density Development by RA4 Process

The samples were exposed to 1/10 seconds of daylight of color temperature 3000K, through 0–3 density step chart in combination with a heat-absorbing filter. After exposure, samples were processed (45 seconds) with the Kodak RA4 process to generate density. The assessment of developability was done by comparing the Dmax of each color record obtained from the DlogE curves to the check coating. The percent developability of each color record was calculated by assigning a value of 100 percent to the check paper. Lower percentages are indicative of slower developability.

Test for Water Resistance

Aqueous solutions of Ponceau Red dye is known to stain gelatin through ionic interaction, therefore it is used to test water resistance of the overcoats. Ponceau Red dye solution was prepared by dissolving 1 gram dye in 1000 grams mixture of acetic acid and water (5 parts: 95 parts). Samples, without being exposed to light, were processed through the Kodak RA4 process to obtain white Dmin samples. The water permeability was done by placing a drop of the dye solution on the s ample for 10 minutes followed by a 30-second water rinse to removed excess dye solution on the coating surface. Each sample was then air dried, and status A reflectance density on the spotted area was recorded. Assuming that the optical density of the check (Example No.B) corresponds to 0% water resistance and that an optical density of 0 corresponds to 100% water resistance, the percent water resistance for a sample is calculated using the following equation.

Percent water resistance=100[1-(status A density of sample/status A density of check)]

Example 1–7

The urethane- vinyl copolymer P1, with various PVAs, were coated over layer 6 of the sensitized paper support described earlier to obtain a nominal coverage of 1.88 g/m$^2$ for P1, to show the effect of molecular weight and degree of hydrolysis of PVAs on developabiliy. All coatings had 35% PVA and one percent by weight CX100 crosslinker with respect to the polymer, P1. For comparison, a check paper as described previously, without the polymer overcoat (Example A) was used. The various PVAs were tested in combination with the urethane-acrylic copolymer for water resistance and dye density development, according to the tests described above. The results are shown in Tables 4, 5, and 6 below.

TABLE 4

| | | Developability | | |
|---|---|---|---|---|
| Example | Description | Red | Green | Blue |
| A | Check | 100 | 100 | 100 |
| 1 | P1 + V1 | 100 | 100 | 99 |
| 2 | P1 + V2 | 99 | 98 | 98 |
| 3 (comparison) | P1 + C3 | 100 | 100 | 98 |
| 4 | P1 + V4 | 98 | 95 | 95 |
| 5 | P1 + V5 | 90 | 86 | 87 |
| 6 | P1 + V6 | 88 | 83 | 86 |
| 7 (comparison) | P1 + C7 | 72 | 69 | 75 |
| 8 (comparison) | P1 + C8 | 70 | 67 | 72 |

It can be seen from the data in Table 4 that molecular weight and percent hydrolysis of the PVAs have a big effect on the developability characteristics. Examples 7–8 and, where the degree of hydrolysis is high (98–99%) and where molecular weight steadily increases, show increasingly less developability. Example 1 shows excellent developability because of its lower molecular weight and lower degree of hydrolysis. Example 2 to 4 also show excellent developability because of its relatively low degree of hydrolysis. Example 5 and 6 show good developability as well in spite of their higher degree of hydrolysis due to its lower molecular weight.

The water resistances of the check and Examples 1–8 are shown in Table 5.

TABLE 5

| Example | PVA | Percent water resistance |
|---|---|---|
| A | None | 0 |
| 1 | V1 | 96 |
| 2 | V2 | 88 |
| 3 (comparison) | C3 | 20 |
| 4 | V4 | 88 |
| 5 | V5 | 96 |
| 6 | V6 | 94 |
| 7 | C7 | 45 |
| 8 | C8 | 42 |

As mentioned before, the percent water resistance is best when the molecular weight is less than about 100K (Examples 1, 2, 4, 5, and 6), since the wash out of these PVAs are efficient under photo processing conditions. Examples 3, 7, and 8 show comparatively lower water-resistance because of their higher molecular weights, resulting in slower wash-out rates.

Example 9–10

The urethane-vinyl copolymer P1, with two different levels of V1 and V1, were coated over layer 7 of the sensitized paper support described earlier to obtain a nominal coverage of 1.88 g/m$^2$ for P1, to show the effect of PVA level on developability. All coatings had 1 weight % CX100 crosslinker with respect to the polymer, P1. Table 6 below shows the ratio of developability of the samples containing a 25 weight % level of PVA compared to a 35 weight % level. As Table 6 below shows, 35 weight % has superior processability compared to the 25 weight % samples especially in the blue layer which being the lower-most layer in the pack is most susceptible to developability issues compared to the layers above it.

TABLE 6

| | | Ratio of developability(25/35) | | |
|---|---|---|---|---|
| Example | PVA type | Red | Green | Blue |
| 9 | V1 | 0.96 | 0.95 | 0.87 |
| 10 | V9 | 0.99 | 0.94 | 0.87 |

As discussed above, increased amounts of PVA may be desirable for improved developability when using higher amounts of polyurethane. These above results suggest that the wt % PVA-with respect to the polyurethane to the laydown of the polyurethane in units of 1.88 g/m$^2$ (175 mg/ft2) was better at a ratio of 19 than at a ratio of 13, in metric units. Since Applicants also found that at a laydown of 1.08 gm$^2$ (100 mg/ft$^2$), a good wt % PVA was 20, for the same ratio of 19 in metric units, this suggests that the relationship between optimal wt % PVA and the laydown of the polyurethane is approproximately linear and, in general, the wt % PVA to laydown of polyurethane is preferably greater than about 10 and more preferably greater than about 15.

The invention has been described in detail with particular reference to certain preferred embodiments thereof, but it will be understood that variations and modifications can be effected within the spirit and scope of the invention.

What is claimed is:

1. An photographic element comprising:

(a) a support;

(b) a silver-halide emulsion layer superposed on a side of said support; and (c) overlying the silver emulsion layer, a processing-solution-permeable protective overcoat having a laydown of at least 0.54 g/m$^2$ (50 mg/ft$^2$) comprising:

(i) polyurethane-containing component comprising urethane polymer in the amount of 20 to 100 percent by weight of the polyurethane-containing component, and an optional vinyl polymer in the amount of 0 to 80 percent by weight of the polyurethane-containing component, wherein the polyurethane-containing component has an acid number of greater than or equal to 5; and (ii) polyvinyl alcohol having a weight average molecular weight and a degree of hydrolysis such that at least 30 percent by weight of the polyvinyl alcohol washes out during photographic processing, wherein the weight average molecular weight of the polyvinyl alcohol is less than or equal to about 150,000, with the proviso that if said molecular weight is greater than about 100,000, then the degree of hydrolysis is less than 95%.

2. The composition of claim 1 wherein the weight average molecular weight of the polyvinyl alcohol is less than or equal to about 150,000, with the proviso that if said molecular weight is greater than about 100,000, then the degree of hydrolysis is less than 95%.

3. The composition of claim 2 wherein the weight average molecular weight of the polyvinyl alcohol is less than or equal to about 100,000, with the proviso that if said molecular weight is greater than about 70,000, then the degree of hydrolysis is less than 95%.

4. The photographic element of claim 1 wherein the polyurethane-containing component of the overcoat is a penetrating or semi-penetrating polymer network comprising at least two polymers.

5. The photographic element of claim 1 wherein the polyurethane-containing component comprises both a vinyl polymer and a polyurethane polymer.

6. The photographic element of claim 1 wherein the polyurethane-containing component comprises monomeric units derived from a polyester polyol, polylactone polyol, polyether polyol, polycarbonate polyol, polyolefin polyol, polysiloxane polyol, or combinations thereof.

7. The photographic element of claim 1 wherein the support comprises polymeric films, papers or glass.

8. The photographic element of claim 1 wherein the support is reflective.

9. The photographic element of claim 5 wherein the support comprises paper base, and a layer of biaxially oriented polyolefin sheet between a first side of said paper base and said silver-halide emulsion layer.

10. The photographic element of claim 1 wherein the overcoat further comprises UV absorbers, surfactants, emulsifiers, coating aids, lubricants, matte particles, rheology modifiers, crosslinking agents, antifoggants, inorganic fillers, pigments, magnetic particles and/or biocides.

11. A method of making a photographic print comprising:

(a) providing a photographic element comprising a support, a silver-halide emulsion layer superposed on a side of said support, a processing-solution-permeable coating overlying the silver-halide emulsion layer, said protective overcoat comprising a polyurethane-containing component having acid functionalities, wherein the weight ratio of urethane polymer in said component comprises from 20 to 100 percent, and the weight ratio of an optional vinyl polymer in said component comprises from 0 to 80 percent, and wherein the polyurethane-containing component has an acid number of greater than or equal to 5, said protective overcoat further comprising a polyvinyl alcohol having a weight average molecular weight of less than or equal to about 150,000, with the proviso that if said molecular weight is greater than about 100,000, then the degree of hydrolysis is less than 95%, wherein the ratio of the weight percent polyvinyl alcohol, relative to the laydown of the polyurethane in g/m$^2$ is greater than about 10;

(b) imagewise exposing the photographic element to light; and (c) developing the photographic element in a developer solution having a pH greater than 7 to obtain the photographic print; and (d) optionally fusing the processing solution permeable overcoat.

12. The method of claim 11 wherein the polyurethane-containing component has an acid number of greater than or equal to 5.

13. The method of claim 11 wherein the ratio of the weight percent polyvinyl alcohol, relative to the polyurethane-containing component, to the laydown of the polyurethane in $g/m^2$ is greater than about 10.

14. The method of claim 11 wherein the overcoat further comprises a polymer selected from the group consisting of cellulose ethers, n-vinyl amides, polyesters, poly(ethylene oxide), starch, proteins, whey, albumin, poly(acrylic acid), alginates, gums, and combinations thereof.

15. The method of claim 11 wherein the fusing step further comprises texturing a surface of the processing solution permeable overcoat.

* * * * *